US008839869B2

(12) United States Patent
Porter et al.

(10) Patent No.: US 8,839,869 B2
(45) Date of Patent: Sep. 23, 2014

(54) COMPOSITE RECONFIGURABLE TOOL

(75) Inventors: Jesse C. Porter, Duncan, OK (US); Joel L. Barlow, Oologah, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 422 days.

(21) Appl. No.: 12/730,650

(22) Filed: Mar. 24, 2010

(65) Prior Publication Data

US 2011/0232899 A1 Sep. 29, 2011

(51) Int. Cl.

| | |
|---|---|
| ***E21B 23/06*** | (2006.01) |
| ***E21B 33/12*** | (2006.01) |
| ***E21B 33/134*** | (2006.01) |
| ***E21B 33/129*** | (2006.01) |
| ***E21B 33/128*** | (2006.01) |

(52) U.S. Cl.

CPC ..... *E21B 33/134* (2013.01); *E21B 33/1292* (2013.01); *E21B 33/128* (2013.01)

USPC ..... 166/382; 166/181

(58) Field of Classification Search

USPC ..... 166/126, 131, 135, 142, 148, 149, 151, 166/192, 181, 382

See application file for complete search history.

(56) References Cited

U.S. PATENT DOCUMENTS

| | | | | |
|---|---|---|---|---|
| 2,714,932 | A * | 8/1955 | Thompson | 166/119 |
| 3,960,399 | A | 6/1976 | Dufrene | |
| 4,232,888 | A | 11/1980 | Amancharla | |
| 4,393,929 | A * | 7/1983 | Akkerman | 166/134 |
| 4,441,559 | A | 4/1984 | Evans et al. | |
| 4,479,548 | A | 10/1984 | Gilbert | |
| 4,493,374 | A | 1/1985 | Magee, Jr. | |
| 4,532,989 | A | 8/1985 | Barker | |
| 4,532,995 | A * | 8/1985 | Kaufman | 166/327 |
| 4,750,564 | A | 6/1988 | Pettigrew et al. | |
| 4,834,184 | A | 5/1989 | Streich et al. | |
| 4,984,632 | A | 1/1991 | Sampa et al. | |
| 5,224,540 | A | 7/1993 | Streich et al. | |
| 5,271,468 | A | 12/1993 | Streich et al. | |

(Continued)

FOREIGN PATENT DOCUMENTS

EP 1564413 A1 8/2005

OTHER PUBLICATIONS

U.S. Appl. No. 12/652,933 titled Downhole Tool Releasing Mechanism, Kevin Ray Manke, et al., filed Jan. 6, 2010.

*Primary Examiner* — Blake Michener

(74) *Attorney, Agent, or Firm* — McAfee & Taft; John Wustenberg

(57) ABSTRACT

A downhole tool for use in a well is configurable as a frac plug, a caged ball frac plug or a bridge plug. The tool has a mandrel with a threaded neck. The mandrel has an expandable sealing element disposed thereabout. An adapter, which may be selected from multiple configurations of adapters, is threaded to the neck of the mandrel. The adapter may comprise a sleeve, or a cap with one open end and one closed end. The adapter has threads on an outer surface thereof to which a threaded setting mandrel may be attached. The setting mandrel when actuated will move the tool to a set position in the well and once the tool is moved to the set position the threads on the adapter will shear so that the setting mandrel may be retrieved. The tool will thus remain in the hole and will act as either a frac plug, a caged ball frac plug or a bridge plug depending upon the configuration of the selected adapter.

17 Claims, 4 Drawing Sheets

(56) References Cited

U.S. PATENT DOCUMENTS

| | | | | |
|---|---|---|---|---|
| 5,404,956 | A | 4/1995 | Bohlen et al. | |
| 5,511,617 | A * | 4/1996 | Snider et al. | 166/291 |
| 5,540,279 | A | 7/1996 | Branch et al. | |
| 5,593,292 | A * | 1/1997 | Ivey | 417/554 |
| 5,701,959 | A | 12/1997 | Hushbeck et al. | |
| 5,839,515 | A | 11/1998 | Yuan et al. | |
| 5,984,007 | A | 11/1999 | Yuan et al. | |
| 6,167,963 | B1 | 1/2001 | McMahan et al. | |
| 6,394,180 | B1 | 5/2002 | Berscheidt et al. | |
| 6,491,116 | B2 | 12/2002 | Berscheidt et al. | |
| 6,695,057 | B2 | 2/2004 | Ingram et al. | |
| 6,708,770 | B2 | 3/2004 | Slup et al. | |
| 6,712,153 | B2 | 3/2004 | Turley et al. | |
| 6,926,086 | B2 * | 8/2005 | Patterson et al. | 166/376 |
| 7,048,066 | B2 | 5/2006 | Ringgenberg et al. | |
| 7,069,997 | B2 * | 7/2006 | Coyes et al. | 166/328 |
| 7,124,831 | B2 | 10/2006 | Turley et al. | |
| 7,350,582 | B2 | 4/2008 | McKeachnie et al. | |
| 7,434,627 | B2 | 10/2008 | Turley et al. | |
| 7,690,436 | B2 * | 4/2010 | Turley et al. | 166/387 |
| 7,740,079 | B2 * | 6/2010 | Clayton et al. | 166/387 |
| 8,113,276 | B2 * | 2/2012 | Greenlee et al. | 166/202 |
| 8,127,856 | B1 * | 3/2012 | Nish et al. | 166/376 |
| 8,267,177 | B1 * | 9/2012 | Vogel et al. | 166/317 |
| 8,307,892 | B2 * | 11/2012 | Frazier | 166/135 |
| 8,336,635 | B2 * | 12/2012 | Greenlee et al. | 166/387 |
| 2003/0188860 | A1 | 10/2003 | Zimmerman et al. | |
| 2004/0045723 | A1 * | 3/2004 | Slup et al. | 166/386 |
| 2006/0131031 | A1 * | 6/2006 | McKeachnie et al. | 166/376 |
| 2006/0243434 | A1 | 11/2006 | Sharp | |
| 2007/0051521 | A1 | 3/2007 | Fike et al. | |
| 2009/0044957 | A1 | 2/2009 | Clayton et al. | |
| 2009/0211749 | A1 * | 8/2009 | Nguyen et al. | 166/75.11 |
| 2010/0155050 | A1 * | 6/2010 | Frazier | 166/102 |
| 2010/0263876 | A1 * | 10/2010 | Frazier | 166/378 |
| 2011/0163560 | A1 * | 7/2011 | Manke et al. | 294/86.18 |
| 2011/0290473 | A1 * | 12/2011 | Frazier | 166/135 |
| 2012/0125637 | A1 * | 5/2012 | Chenault et al. | 166/382 |
| 2012/0279700 | A1 * | 11/2012 | Frazier | 166/193 |

* cited by examiner

COMPOSITE RECONFIGURABLE TOOL

BACKGROUND

This disclosure generally relates to tools used in oil and gas wellbores. More specifically, the disclosure relates to drillable packers and pressure isolation tools.

In the drilling or reworking of oil wells, a great variety of downhole tools are used. Such downhole tools often have drillable components made from metallic or non-metallic materials such as soft steel, cast iron or engineering grade plastics and composite materials. For example, but not by way of limitation, it is often desirable to seal tubing or other pipe in the well when it is desired to pump a slurry down the tubing and force the slurry out into the formation. The slurry may include for example fracturing fluid. It is necessary to seal the tubing with respect to the well casing and to prevent the fluid pressure of the slurry from lifting the tubing out of the well and likewise to force the slurry into the formation if that is the desired result. Downhole tools referred to as packers, frac plugs and bridge plugs are designed for these general purposes and are well known in the art of producing oil and gas.

Bridge plugs isolate the portion of the well below the bridge plug from the portion of the well thereabove. Thus, there is no communication from the portions above and below the bridge plug. Frac plugs, on the other hand, allow fluid flow in one direction but prevent flow in the other. For example, frac plugs set in a well may allow fluid from below the frac plug to pass upwardly therethrough but when the slurry is pumped into the well, the frac plug will not allow flow therethrough so that any fluid being pumped down the well may be forced into a formation above the frac plug. Generally, the tool is assembled as a frac plug or bridge plug. An easily disassemblable tool that can be configured as a frac plug or a bridge plug provides advantages over prior art tools. While there are some tools that are convertible, there is a continuing need for tools that may be converted between frac plugs and bridge plugs more easily and efficiently. In addition, tools that allow for high run-in speeds are desired.

Thus, while there are a number of pressure isolation tools on the market, there is a continuing need for improved pressure isolation tools including frac plugs and bridge plugs.

DESCRIPTION OF AN EMBODIMENT

Figure 1:
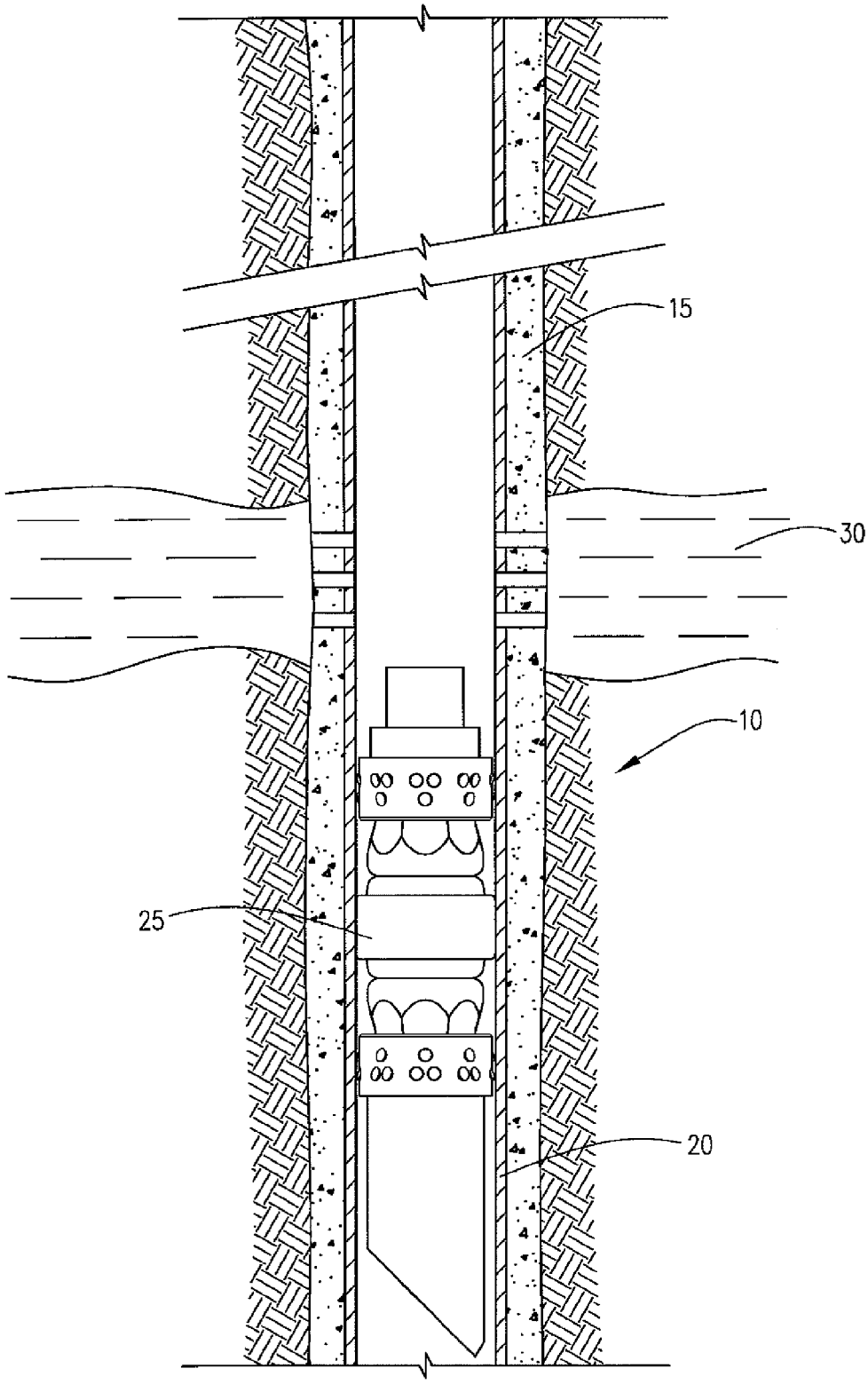
FIG. 1 schematically shows a downhole tool disposed in a well.
Figure 2:
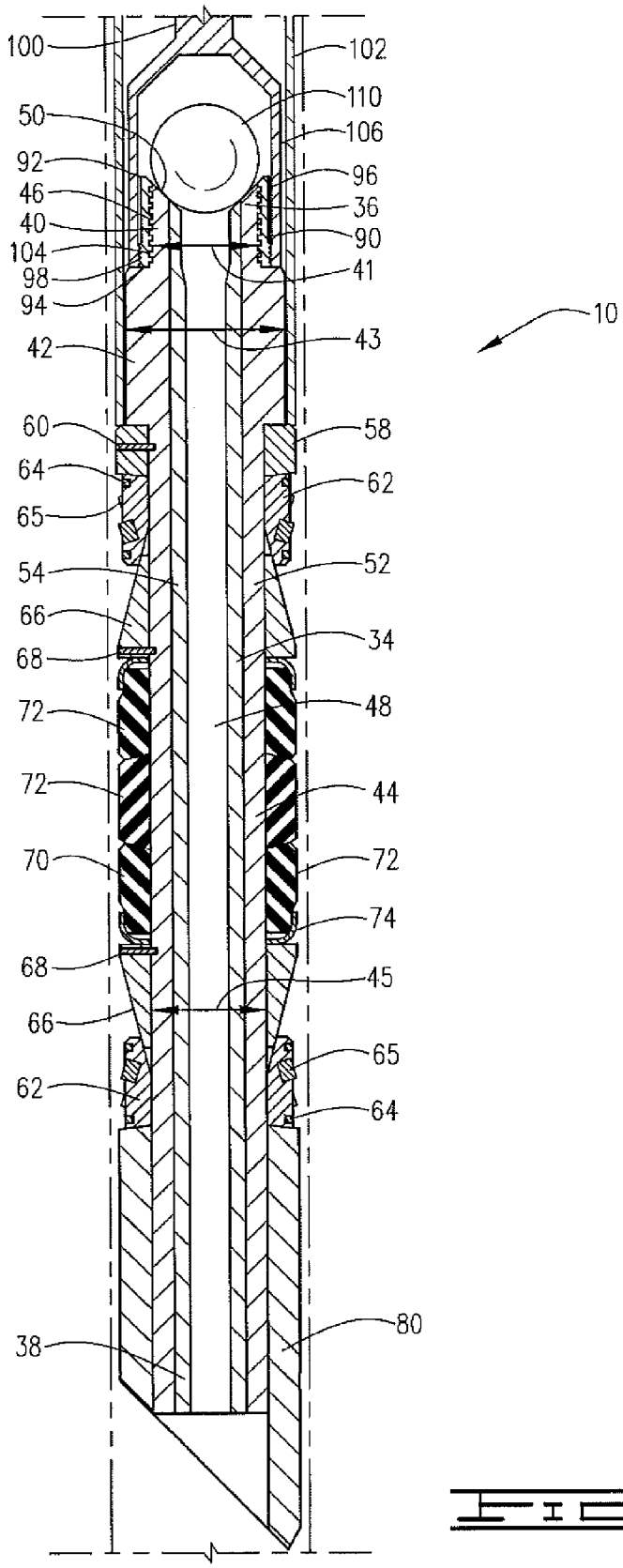
FIG. 2 is a cross-sectional view of one embodiment of the tool.
Figure 3:
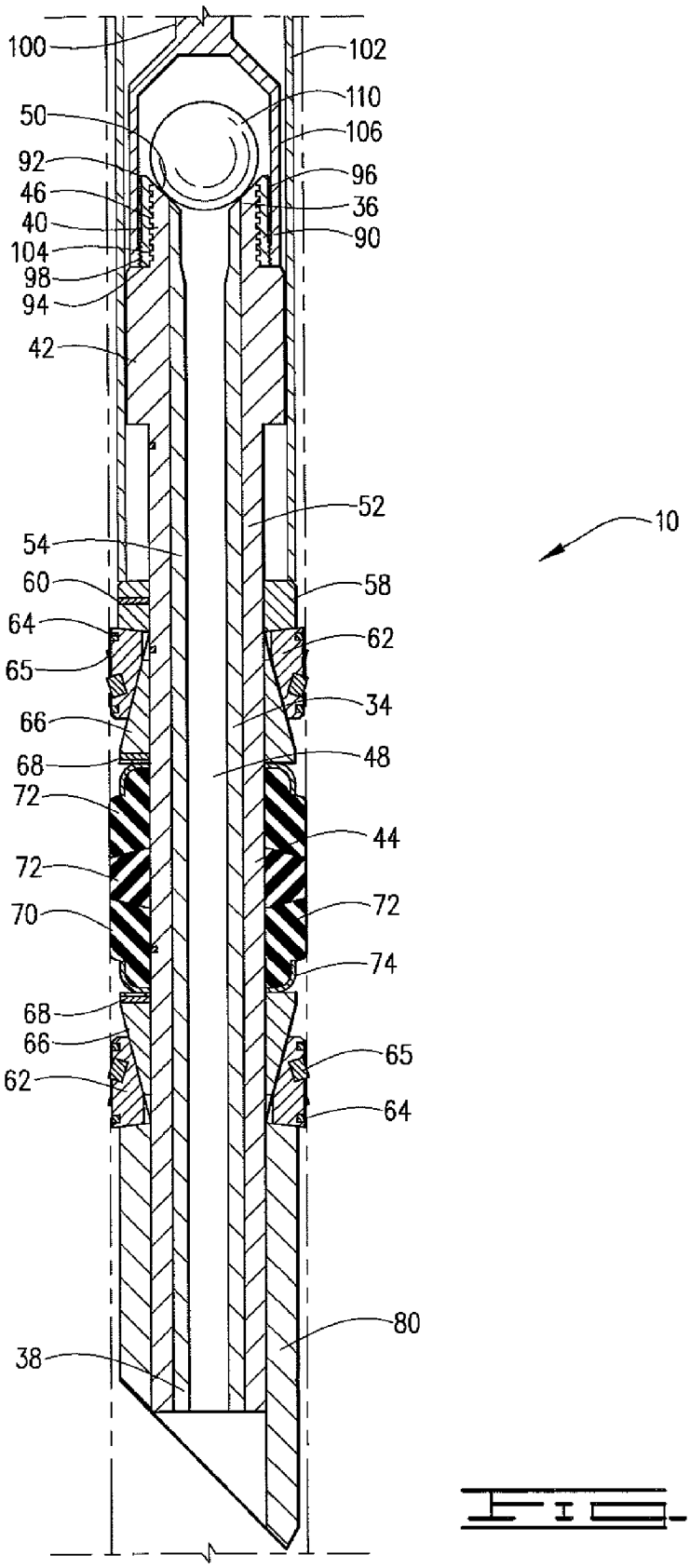
FIG. 3 is a cross-sectional view of the tool in an expanded position wherein the tool engages a well.

Referring to the drawings and particularly to FIG. 1, a well 10 comprising wellbore 15 with a casing 20 cemented in the wellbore is shown with tool 25 set in casing 20. Well 10 intersects a formation 30 above and intersects at least a second formation therebelow (not shown). Tool 25 is positioned therebetween. As will be described in detail herein, tool 25 may be configured as a standard frac plug (FIG. 2) in which a ball engages the upper end thereof, a caged ball frac plug (FIG. 4) or a bridge plug (FIG. 5). Tool 25 is a drillable tool and is preferably a drillable composite product that is easily convertible to any of the three configurations mentioned herein. Referring now to FIG. 2, tool 25 comprises a mandrel 34 with a first or upper end 36 and a second or lower end 38. Mandrel 34 has neck portion 40 with an outer diameter 41, shoulder or hub 42 with outer diameter 43 positioned radially outwardly from neck 40 and a body portion 44 which is positioned radially inwardly from hub 42 and extends axially therefrom. Body portion 44 has an outer diameter 45. Neck 40 has threads 46 on the outer surface thereof for connection to multiple shaped adapters. The adapters are shaped to configure tool 25 in a plurality of configurations. Mandrel 34 defines a flow passage therethrough extending from the upper end 36 to the lower end 38 thereof. A seat 50 is defined at the upper end thereof. Mandrel 34 may be a two-piece mandrel and thus may comprise an outer mandrel 52 and an inner mandrel 54 bonded thereto. The outer and inner mandrels 52 and 54 may be made from the same, or different materials and may comprise, for example, molded phenolic or a composite material.

Tool 25 may include a spacer ring 58 pinned to mandrel 34 with pins 60 to axially retain slip segments 62 which are circumferentially positioned about mandrel 34. Slip retaining band 64 may be utilized to radially retain slip segments 62 in the initial or unset position shown in FIG. 2. Slips 62 may include a plurality of buttons 65, which may be for example like those disclosed in U.S. Pat. No. 5,984,007 assigned to the assignee thereof. Band 64 may be made of steel wire, plastic material or composite material having the requisite characteristics in sufficient strength to hold the slips in place while running tool 25 in the well and prior to setting tool 25. Band 64 may be drillable so that if desired to remove the tool from the well 10, tool 25 may be drilled therefrom.

A slip wedge 66 may be initially positioned in a slidable relationship to and partially beneath slip segments 62. Slip wedge 66 may be pinned in place with a pin 68. Packer element assembly 70, which in the embodiment shown comprises three expandable sealing, or packer elements 72, is disposed about mandrel 34. Shoes 74 may be disposed about mandrel 34 at upper and lower ends of packer element assembly 70. The slips, slip wedges and packer shoes may be made of drillable materials, for example, non-metallic materials such as phenolics or composites.

Tool 25 has a lower or second end section 80 which may be referred to as a shoe or mule shoe 80. Lower end section 80 is connected to mandrel 34 and for example may be connected by threading. Other connections, such as a pinned connection may be used as well.

Mandrel 34 is configured to accept or be connected to adapters of multiple configurations such that the tool 25 is a reconfigurable tool that may be configured as a standard frac plug, a caged ball frac plug or a bridge plug. FIG. 2 shows tool 25 as a standard frac plug. Thus, an adapter 90, which may be referred to as sleeve 90, with open upper and lower ends 92 and 94 is threaded onto neck portion 40. Sleeve 90 has outer surface 96 with a thread 98 defined thereon.

In FIG. 2 tool 25 is shown in the run-in position with a setting mandrel 100 connected thereto. Setting mandrel 100 and setting sleeve 102 comprise part of the setting tool utilized to move downhole tool 25 from the unset to the set position in which the sealing elements 72 engage casing 20.

Actuation of setting mandrel 100 may be by electrical charge, explosive means or other known means in the art. Prior art setting mandrels typically attach to the mandrel of the tool being set in the well with shear pins. Setting mandrel 100 has a thread 104 on an inner surface 106 thereof that will mate with thread 98 and sleeve 90. When the setting tool is actuated to move mandrel 100 upwardly, setting sleeve 102 will remain stationary. End section 80 will be pulled upwardly since it is fixedly attached to mandrel 34. Components disposed about mandrel 34 will be compressed, since spacer ring 58 is held essentially stationary by setting sleeve 102. Thus, upward movement will cause compression and expansion of sealing elements 72. Slip segments 62 will slide over and be moved radially outwardly upon slip wedges 66 and will engage casing 20. Sealing elements 72 will be expanded outwardly and moved to the set position in which they engage casing 20. When tool 25 is moved to the set position threads 98 on sleeve 90 are designed to shear, so that setting mandrel 100 will be released therefrom and can be pulled upwardly, along with setting sleeve 102 in a manner known in the art. Thread 98 is designed to shear at the load required to move tool 25 to the set position, which may be, for example, 20,000 to 30,000 pounds. The loads provided herein are non-limiting and are merely exemplary.

In FIG. 2, a frac ball 110 is shown lowered into the well along with setting mandrel and setting sleeve 100 and 102, respectively. Once tool 25 is set in the well, fluid pressure increased in the well will fracture a zone thereabove, for example zone 30 depicted in FIG. 1. Once pressure is released, fluid from zone 30 can flow upwardly in the well as can fluid from formations therebelow which will flow through central passage 48. While FIG. 2 depicts ball 110 lowered into well 10 with setting mandrel 100, the tool can be set without the frac ball 110 and after setting mandrel 100 and setting sleeve 102 are removed from well 10 ball 110 can be dropped through the well so that it will engage seat 50.

Figure 4:
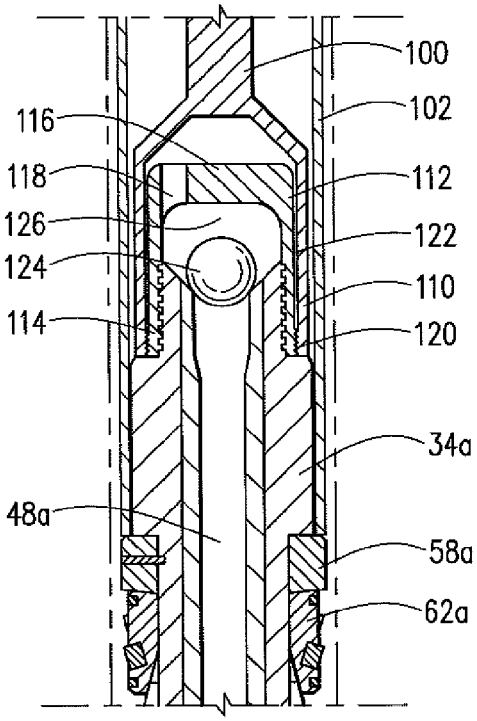
FIGS. 4 and 5 are cross-sectional views of a tool reconfigured with separate adapters for use as a cased ball frac plug and a bridge plug.
Figure 5:
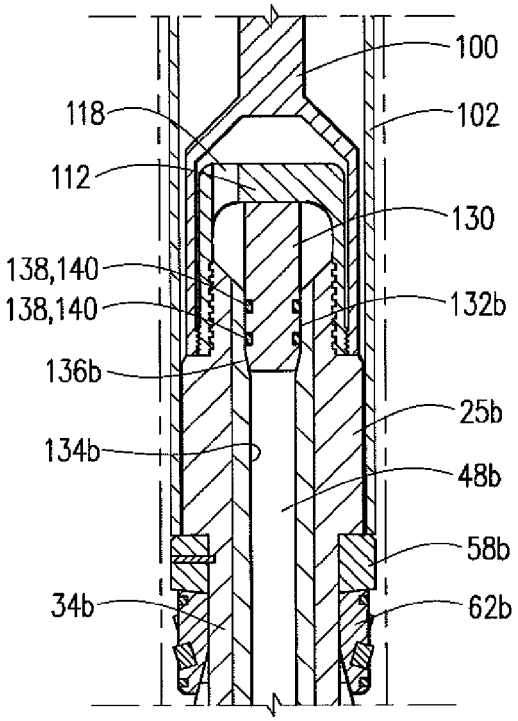

The embodiments of FIGS. 4 and 5 will be referred to as tools 25*a* and 25*b* simply for ease of reference. In both of the embodiments of FIGS. 4 and 5, mandrel 34 is identical in all respects to that described with respect to FIG. 2. The primary distinction is in the adapter that is connected to mandrel 34 at threads 46. Tool 25*a* includes an adapter that is a cap 112 which comprises a side wall 114 and a top 116 which may be referred to as a closed top 116. Cap 112 has at least one and preferably a plurality of fluid ports 118 therethrough to permit fluid flow. Cap 112 has a thread 120 defined on the outer surface 122 of side wall 114. Thread 120 is identical to thread 98. Tool 25*a* is moved to the set position in the same manner as described with respect to tool 25. Thus, setting mandrel 100 will be threadedly connected to cap 112 and when actuated will pull mandrel 34 upwardly to move tool 25*a* to the set position. Once tool 25*a* is moved to the set position, threads 120 will shear and setting mandrel 100 and setting sleeve 102 can be removed from well 10. Tool 25*a* further includes a frac ball 124. Frac ball 124 is smaller than frac ball 110 and is designed to be captured in a space 126 between upper end 36 of mandrel 34 and top 116 of cap 112. Once tool 25*a* is moved to the set position, fluid pressure in well 10 will cause frac ball 124 to engage seat 50*a* to prevent flow downwardly through central flow passage 48*a*. Once a formation thereabove, for example, formation 30, is fractured, fluid pressure is released and fluid from a formation therebelow, for example, may pass upwardly through tool 25*a* and fluid ports 118 to the surface. Thus, tool 25*a* by utilizing cap 112 and frac ball 124 is configured as a caged ball frac plug, whereas the tool of FIG. 2 is configured as a standard frac plug.

FIG. 5 shows tool 25*b* which is identical in all aspects to tool 25*a* except that instead of frac ball 124, a plug 130 is utilized so that tool 25*b* is configured as a bridge plug which, once set in the well will prevent flow downwardly and upwardly through tool 25*b*. As is apparent from the drawings, mandrel 34*b* has first and second inner surfaces 132*b* and 134*b*. Inner surface 132*b* has a diameter slightly greater than an inner diameter of surface 134*b*. A transition portion 136*b* extends between surfaces 132*b* and 134*b*. Transition surface 136*b* is essentially an angular shoulder. Plug 130 is sealingly received in flow passage 48*b* and includes O-rings 138 received in grooves 140 which will engage surface 132*b*. Plug 130 is captured by cap 112 and transition surface 136*b* and as such is prevented from moving downwardly through tool 25*b* and is likewise prevented from being forced upwardly by cap 112. Thus, tool 25*b* utilizes an adapter which comprises cap 112 with plug 130 such that tool 25*b* is configured as a bridge plug.

The tool described herein is thus configurable as a standard frac plug, a caged ball frac plug or bridge plug simply by utilizing one of a plurality of adapters. The adapters may be configured as a sleeve with two open ends such as for example sleeve 90 or a cap like cap 112. The tool can be configured in any of the multiple configurations described herein simply by selecting and utilizing a cap that will configure the tool as desired. Tools 25, 25*a* and 25*b* all set in the same manner. As described herein, the tools are set by actuating a setting tool which will cause setting mandrel 100 to pull mandrel 34 upwardly until the tool is set in the well at which point the threads on the adapter, whether sleeve 90 or cap 112, will shear thus releasing setting mandrel 100 and setting sleeve 102 so that they may be retrieved to the surface.

It will be seen therefore, that the present invention is well adapted to carry out the ends and advantages mentioned, as well as those inherent therein. While the presently preferred embodiment of the apparatus has been shown for the purposes of this disclosure, numerous changes in the arrangement and construction of parts may be made by those skilled in the art. All of such changes are encompassed within the scope and spirit of the appended claims.

What is claimed is:

1. A reconfigurable downhole tool for use in a well comprising:

a mandrel, the mandrel defining a threaded neck;

an expandable sealing element disposed about the mandrel expandable from an unset to a set position in the well; and an adapter threadedly connected to the threaded neck of the mandrel, the adapter having threads on an outer surface thereof for connection to a setting tool, wherein the threads on the outer surface of the adapter will shear to release the setting tool after the sealing element is expanded to the set position in the well such that the sealing element remains in the set position after the shearing and where the adapter will not shear at an other location along the length of the adapter and wherein the adapter comprises a cap threaded onto the neck of the mandrel, the cap comprising a side wall and a top, the top having at least one port to allow fluid flow therethrough, wherein said side wall forms an open first end having threads for threading onto the neck of the mandrel and said top forms a closed second end which is closed so as to capture a plug within the side wall and between the mandrel and the top.

2. The tool of claim 1, wherein the plug is a ball trapped in and movable in a space between the top of the cap and an upper end of the mandrel.

3. The tool of claim 2, wherein fluid pressure applied in the well above the tool will move the ball into engagement with the upper end of the mandrel to prevent downward flow therethrough, and wherein upon the release of fluid pressure above the tool, the ball may be disengaged from the upper end of the mandrel to allow upward flow therethrough.

4. The tool of claim 1, wherein the plug is a bridge plug trapped by the mandrel and the top of the cap to prevent flow through the tool.

5. The tool of claim 4, wherein the plug is sealingly received in the mandrel.

6. The tool of claim 5, the mandrel having first and second diameters and having a transition surface therebetween, the plug being trapped by the transition surface and the top of the cap.

7. The downhole tool of claim 1, wherein the threads on the outer surface of the adapter are designed to shear at the load required to move the downhole tool to the set position.

8. A downhole tool configurable for use as a caged ball frac plug standard frac or a bridge plug comprising:

a mandrel defining a central flow passage therethrough and defining a seat at an upper end thereof, the mandrel comprising a neck portion, a shoulder positioned below the neck portion and extending radially outwardly from the neck portion, and a body portion positioned below and radially inward from the shoulder portion such that the body portion has an outer diameter less than the outer diameter of the shoulder portion;

a sealing element disposed about the body portion of the mandrel movable in a well from an unset position to a set position in which the sealing element engages the well upon the application of a setting force applied by a setting mandrel; and a threaded adapter threadedly connected to the neck portion by a first thread and threadedly connected to the setting mandrel by a second thread, wherein the neck portion has a thread thereon for connecting to the threaded adapter, wherein the adapter comprises a cap threaded onto the neck portion of the mandrel, the cap comprising a side wall and a top, the top having at least one port to allow fluid flow therethrough, wherein said side wall forms an open first end having threads for threading onto the neck portion of the mandrel and said top forms a closed second end which is closed so as to be configured to capture a plug within the side wall and between the mandrel and the top such that the tool can be configured as a caged ball frac plug or as a caged ball frac plug or a bridge plug and wherein the second thread on the threaded adapter will shear and disconnect from the setting mandrel after the setting force is applied to the downhole tool to move the sealing element to the set position such that the sealing element remains in the set position after the shearing, and where the adapter will not shear at any other location along the length of the adapter.

9. The downhole tool of claim 8, wherein the plug is a frac ball movably entrapped between the closed end of the adapter and the first end of the mandrel.

10. The downhole tool of claim 8, wherein the plug is a bridge plug sealingly engaging the flow passage defined by the mandrel and held in place by the closed second end of the adapter.

11. The downhole tool of claim 8, wherein the second thread on the threaded adapter is designed to shear and disconnect from the setting mandrel at the load required to move the downhole tool to the set position.

12. A tool for use in a well comprising:

a mandrel configured to accept multiple shaped adapters comprising:

a neck portion having an external thread thereon for connection to one of the adapters;

a shoulder positioned below the neck portion and extending axially and radially outwardly from the neck portion; and a mandrel body positioned below the shoulder and extending axially and radially inwardly from the shoulder such that the mandrel body has an outer diameter less than the outer diameter of the shoulder portion, the neck portion configured to connect to multiple adapters so that an assembly of an adapter and the mandrel can comprise a caged ball frac plug or a bridge plug;

an adapter having a thread by which the adapter is threadedly connected to the neck portion wherein the adapter comprises a cap threaded onto the neck portion of the mandrel, the cap comprising a side wall and a top, the top having at least one port to allow fluid flow therethrough, wherein said side wall forms an open first end having threads for threading onto the neck portion of the mandrel and said top forms a closed second end which is closed so as to capture a plug within the side wall and between the mandrel and the top; and an expandable sealing element disposed about the mandrel and movable from an unset to a set position in the well by a setting mandrel, the adapter having outer threads thereon for connecting to the setting mandrel, wherein the outer threads on the adapter will shear to release the setting mandrel after the sealing element is moved to the set position such that the sealing element remains in the set position after the shearing and wherein the adapter will not shear at any other location along the length of the adapter.

13. The tool of claim 12, wherein the plug is a ball trapped in and movable in a space defined by the adapter and an upper end of the mandrel.

14. The tool of claim 12, wherein the plug is a bridge plug positioned in the mandrel and extending therefrom, wherein the top of the adapter holds the plug in place in the mandrel.

15. The downhole tool of claim 12, wherein the outer threads on the adapter are designed to shear to release the setting mandrel at the load required to move the downhole tool to the set position.

16. A method for setting a downhole tool in a well comprising:

(a) selecting an adapter to attach a mandrel of the downhole tool to a setting tool wherein the adapter is selected from adapters designed to configure the downhole tool as a caged ball frac plug and a bridge plug and wherein said adapter has a thread designed to connect it to the setting tool;

(b) connecting the adapter to the mandrel in order to configure the downhole tool as a caged ball standard frac plug, a caged ball frac plug or a bridge plug wherein the adapter comprises a cap threaded onto the neck of the mandrel, the cap comprising a side wall and a top, the top having at least one port to allow fluid flow therethrough, wherein said side wall forms an open first end having threads for threading onto the neck of the mandrel and said top forms a closed second end which is closed so as to be configured to capture a plug within the side wall and between the mandrel and the top and wherein the adapter is connected to the mandrel such that the downhole tool is reconfigurable as a caged ball ball frac plug or a bridge plug by removing the adaptor and connecting a different adaptor thereto;

(c) connecting the adapter to the setting tool;

(d) lowering the downhole tool in the well;

(e) actuating the setting tool so that a sealing element disposed about the mandrel is expanded to set the downhole tool;

(f) after the downhole tool is set, shearing the threads on the adapter to release the setting tool while keeping the downhole tool set; and (g) removing the setting tool from the well.

17. The downhole tool of claim 16, wherein the thread on the adapter is designed to shear and disconnect from the setting tool at the load required to move the downhole tool to the set position.

* * * * *